US007182352B1

(12) United States Patent
Gonzalez

(10) Patent No.: US 7,182,352 B1
(45) Date of Patent: Feb. 27, 2007

(54) ICE SKATING TRAINER

(76) Inventor: Jesus Gonzalez, 12970 SW. 17 Ter., Miami, FL (US) 33175

( * ) Notice: Subject to any disclaimer, the term of this patent is extended or adjusted under 35 U.S.C. 154(b) by 147 days.

(21) Appl. No.: 11/045,662

(22) Filed: Jan. 31, 2005

(51) Int. Cl.
*B62M 1/00* (2006.01)

(52) U.S. Cl. ..... 280/87.021; 280/87.041; 280/28.11

(58) Field of Classification Search ..... 280/87.01, 280/87.021, 87.041, 87.051, 7.12, 23.1, 11.204, 280/11.211, 816, 14.21, 14.27, 28.11, 28.15
See application file for complete search history.

(56) References Cited

U.S. PATENT DOCUMENTS 2,327,671 A * 8/1943 Rupperecht ..... 280/87.021
2,900,008 A * 8/1959 Seger ..... 482/66
3,695,609 A * 10/1972 Rothe ..... 482/66
D301,598 S * 6/1989 Harris ..... D21/771
5,397,154 A * 3/1995 Baldwin ..... 280/818
5,538,268 A * 7/1996 Miller ..... 280/87.05
D420,624 S 2/2000 Gonzalez ..... D12/130
6,070,603 A * 6/2000 Politz ..... 135/67
D433,475 S 11/2000 Gonzalez ..... D21/771
6,296,263 B1 * 10/2001 Schultz et al. ..... 280/87.021
D496,421 S * 9/2004 Meeker ..... D21/771
6,837,503 B2 * 1/2005 Chen et al. ..... 280/87.021
7,040,637 B2 * 5/2006 Owens et al. ..... 280/87.021

* cited by examiner

*Primary Examiner*—Christopher Bottorff
(74) *Attorney, Agent, or Firm*—Sanchelima & Assoc. P.A.

(57) ABSTRACT

A skating training device with a V-shape frame that has a front end and two rear portions with handles. The front end includes a wheeled leg and the rear portions include rear legs that terminate with skating blade assemblies. A brake system includes actuating levers that transmit a force of predetermined magnitude to an elongated bar that is pivotally mounted to the blade assemblies and include a braking teethed plate mounted thereto so that predetermined movements of the actuating lever result in causing the teethed plate member to sink against the ice surface. Optionally, the blade assemblies can be replaced with wheel assemblies for land skating.

3 Claims, 6 Drawing Sheets

Fig 1
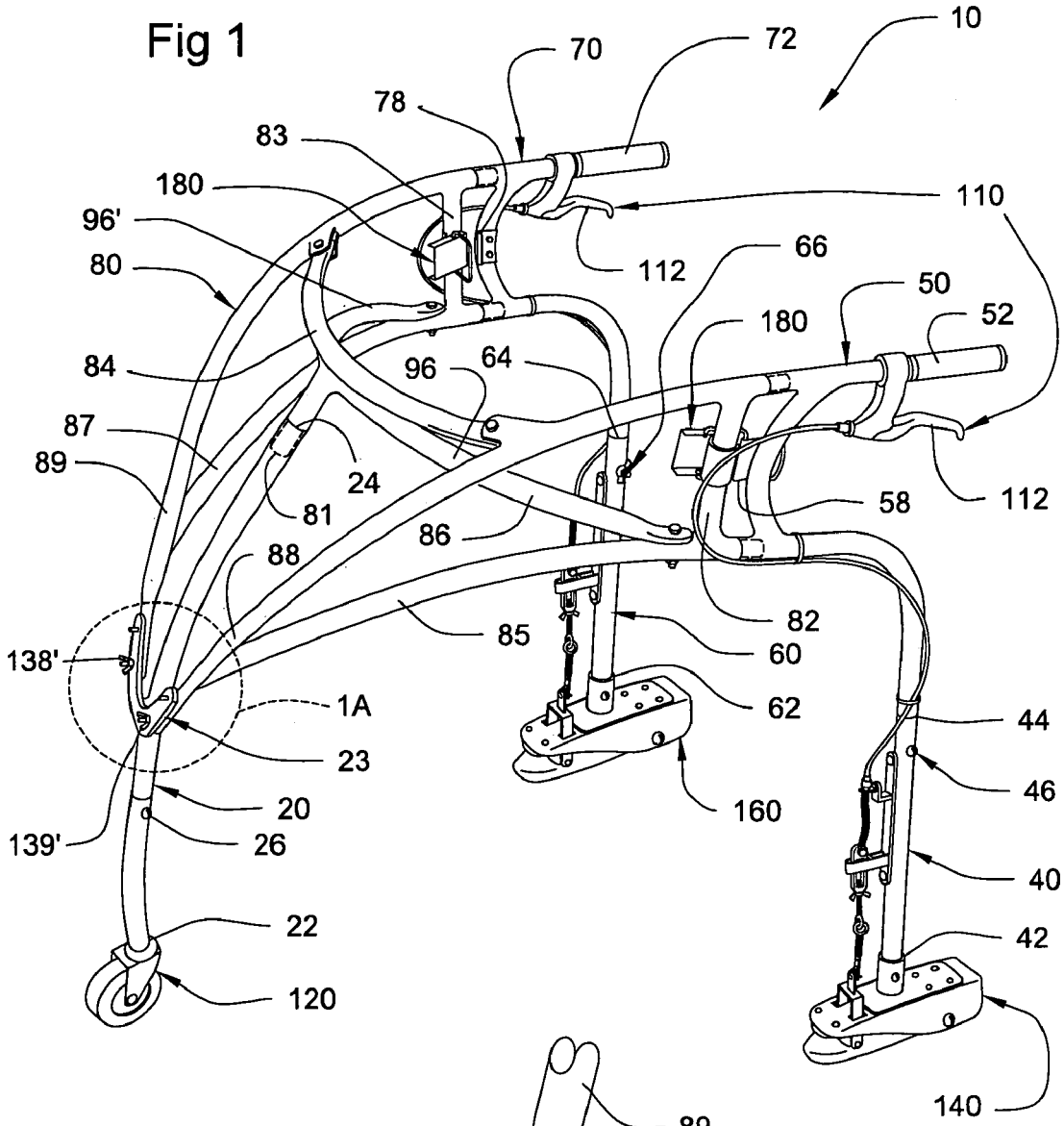
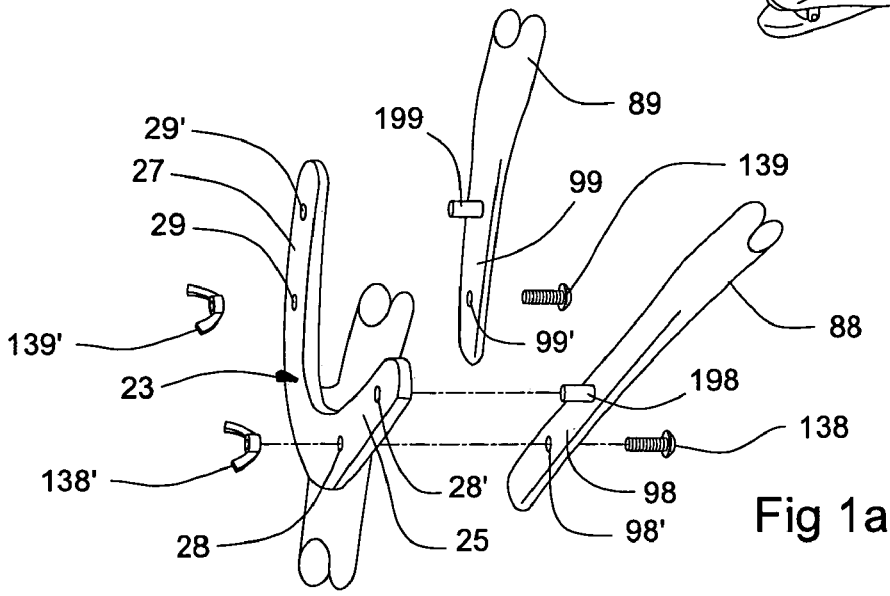
Fig 1a 116
117
111
127
126
129
128

118
132
134
130
119

70
124
110
64
66
3a
115
125
117
116
114
60
62
160
118
150
66
60

Fig 5
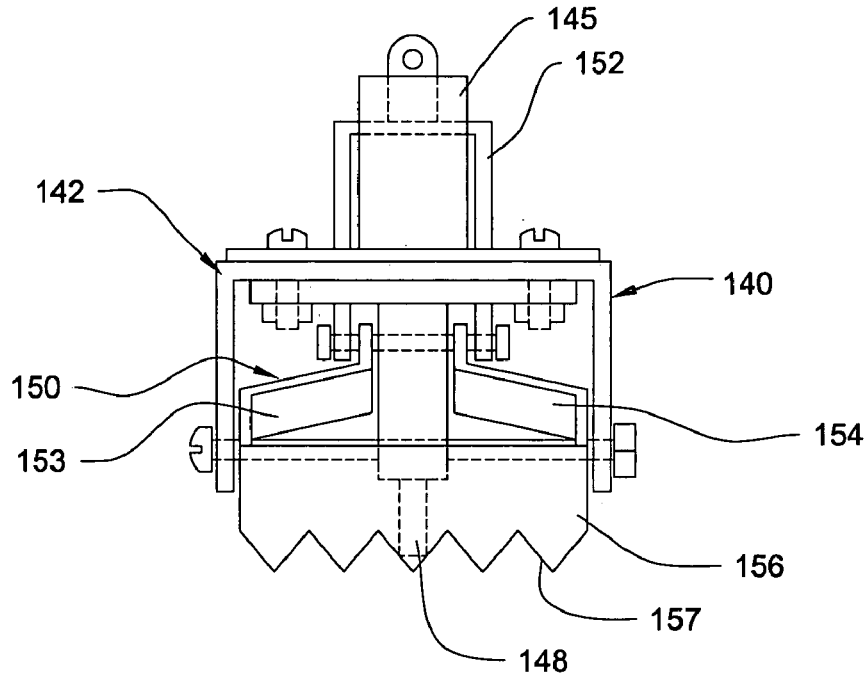
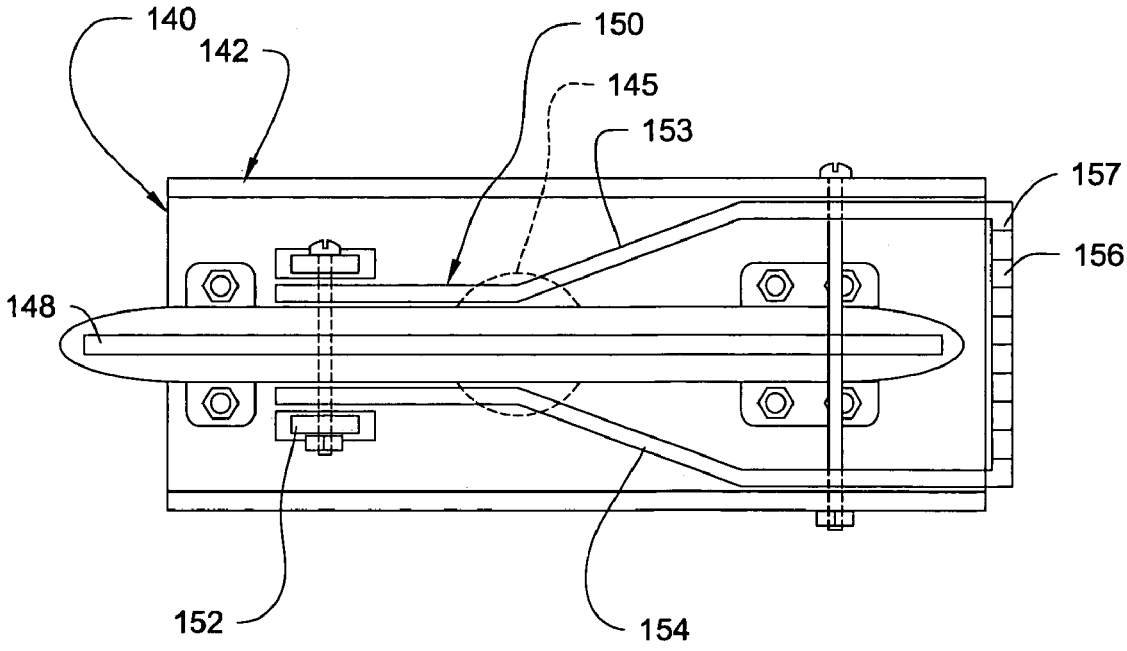
Fig 6

ICE SKATING TRAINER

BACKGROUND OF THE INVENTION

1. Field of the Invention

The present invention relates to a trainer for ice skaters.

2. Description of the Related Art

Several designs for ice skating have trainers been designed in the past. None of them, however, includes two ice skate assemblies mounted to rear legs and wheel member rotatably mounted to a front leg assembly that provides the necessary support for a user. Additionally, the present invention has an upper frame with two handles and brake assemblies mounted thereto that permit a user to safely skate and maintain his/her equilibrium. These features are not disclosed by the prior art and provide a safe and novel device for practicing ice skating.

Applicant believes that the closest reference corresponds to U.S. design patent No. D420,624 issued to the inventor of the present patent application on Feb. 15, 2000 for a wheeled trainer for skating and U.S. design patent No. D433,475 also issued to the inventor of the present patent application on Nov. 7, 2000 for a wheeled trainer for skating. However, these patents differ from the present invention because the issued patents provide for wheeled designs for land skating only. The present invention includes an ice skating blade assemblies that are readily mountable and replaceably with wheeled assemblies. The present invention also includes a brake mechanism that can be actuated by the user from handles on the frame resembling those of a conventional bicycle.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a safe training apparatus for ice skaters.

It is another object of this invention to provide an ice skating trainer device with a brake mechanism that permits a user to control his/her speed.

It is still another object of the present invention to provide an ice skating trainer device that permits a user to readily steer it.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 1 represents an isometric view of one of the preferred embodiments for the ice skating trainer object of the present application.

FIG. 1*a* is an exploded isometric view of the transversal V-shaped plate member and portions of the flattened ends.

FIG. 5 is a rear view of the ice skate assembly represented in the previous figure, showing the brake plate.

FIG. 6 is a bottom view of the ice skate assembly represented in the previous figure, showing the brake assembly.

DETAILED DESCRIPTION OF THE PREFERRED EMBODIMENT

Figure 2:
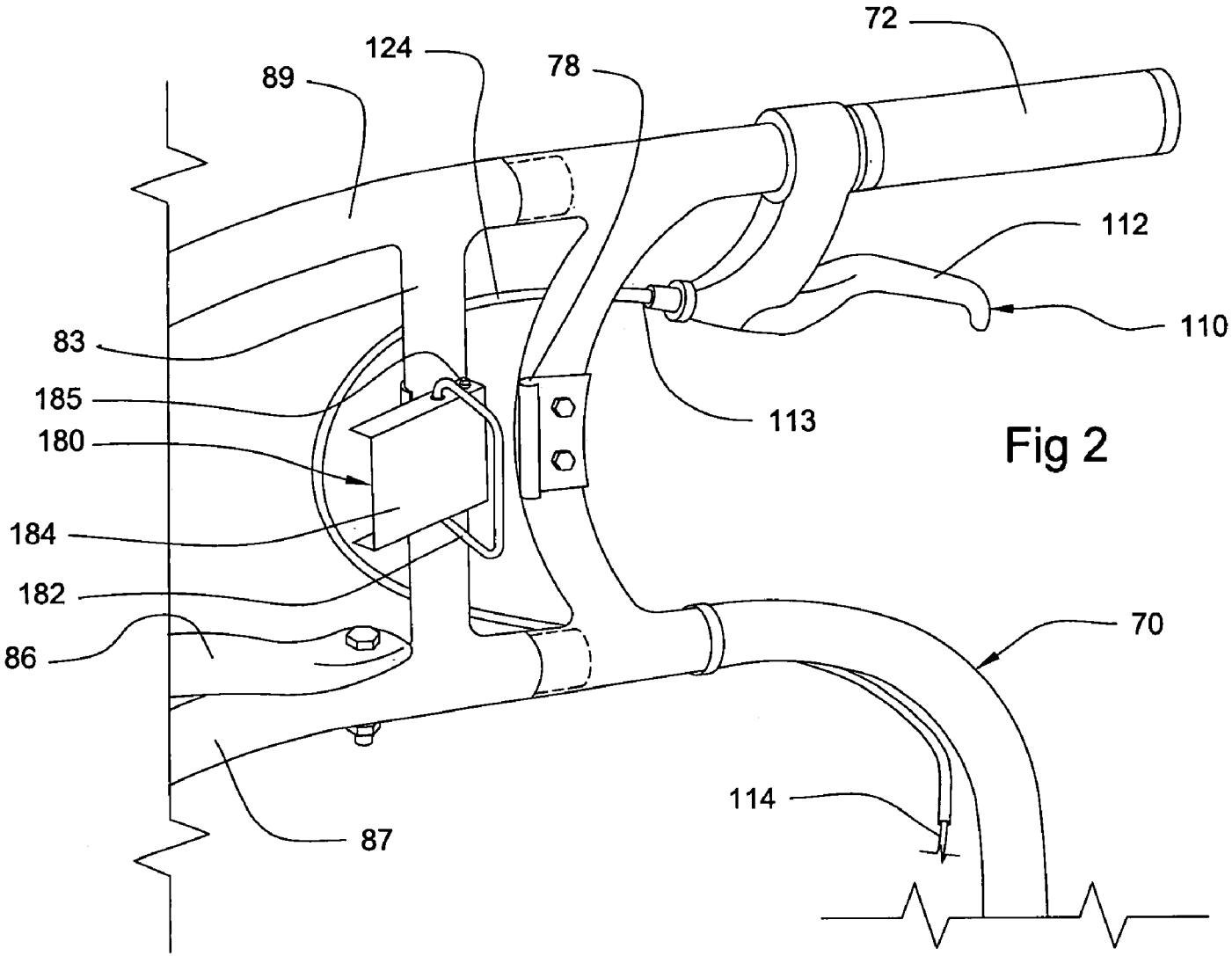
FIG. 2 shows a partial isometric view of one rear portions of the frame with its handle.

Referring now to the drawings, where the present invention is generally referred to with numeral 10, it can be observed that it basically includes front leg assembly 20, rear leg assemblies 40 and 60, frame assembly 80, rear portions 50 and 70, brake mechanism 110, wheel assembly 120 and blade assemblies 140 and 160.

As shown in FIG. 1, front leg assembly 20 includes lower and upper ends 22 and 24, respectively. Upper end 24 is removable mounted to frame assembly 80 with transversal V-shaped plate member 23. V-shaped plate member 23 is mounted to front leg assembly 20 at a point between lower 22 and upper end 24. As best seen in FIG. 1*a*, V-shaped plate member 23 includes arms 25 and 27. Arm 25 includes through openings 28 and 28' and arm 27 includes through opening 29 and 29'. As seen in FIG. 1, front leg assembly 20 also includes telescopic mechanism 26 to cooperatively increase or decrease the effective length of leg assembly 20 depending on the user's needs. Wheel assembly 120 is mounted to lower end 22 to provide a support point for the structure.

Figures 3, 3A, 3B, 3C:
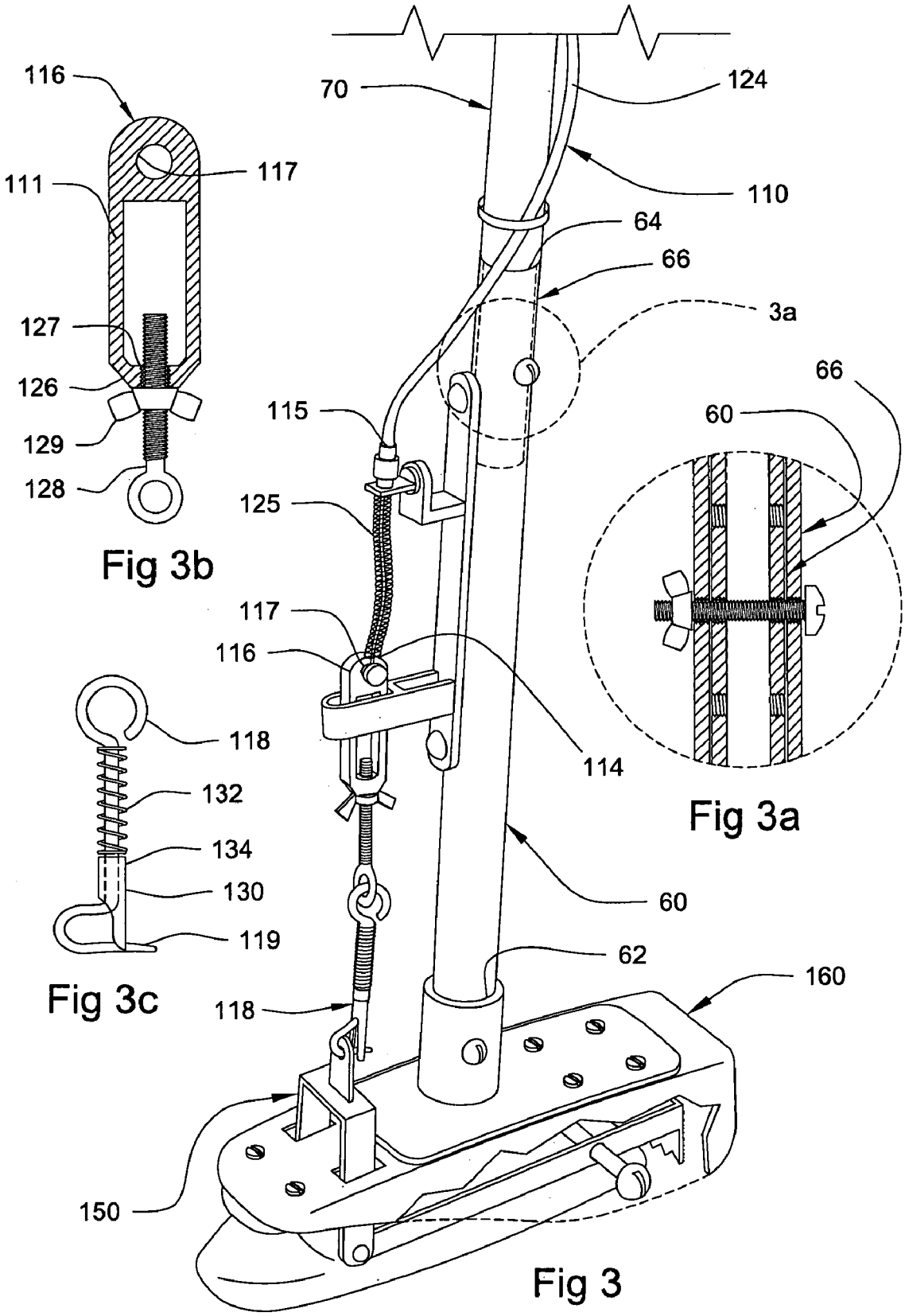
FIG. 3 illustrates a partial isometric view of one of the ice skating trainer, showing its lower portion and the corresponding leg member.
FIG. 3*a* is a detail cross-sectional view of the telescopic mechanism.
FIG. 3*b* is an enlarged front elevational view with a partial cross-section of the adjusting member.
FIG. 3*c* is an enlarged front elevational view of the hook member.

As shown in FIG. 1, rear portions 50 and 70 have preferably the same size and configuration. Rear portions 50 and 70 include handle 52 and 72, respectively. Rear portions 50 and 70 are releasably mounted to frame assembly 80. Locking assemblies 180 keep portions 50 and 70 releasably mounted to frame assembly 80. Rear portion 70 (and similarly rear portion 50) has elongated leg 60 (and 40) releasably mounted thereto. As seen in FIGS. 1 and 3, elongated leg 60 (and 40) includes lower end 62 (and 42) and upper end 64 (and 44). Rear leg 60 (and 40) has telescopic mechanism 66 (and 46) to cooperatively increase or decrease its effective height depending on the user's requirements. An enlarged cross-section of telescopic mechanism 66 (or 46) is shown in FIG. 3*a*, which represents one of the preferred embodiments. Other similar telescopic mechanisms can also be utilized. Skating blade assemblies 140 and 160 are releasably mounted to lower ends 42 and 62, respectively, as seen in FIG. 1.

As best seen in FIG. 1, frame assembly 80 is made of tubular members and has a substantially double V-shape in the preferred embodiment. Frame assembly 80 includes spacer rear members 82 and 83, transversal reinforcement member 84 and transversal reinforcement assembly 86, lower frame members 85 and 87 and upper frame members 88 and 89. Spacer rear member 82 is mounted substantially adjacent to the rear ends of frame members 85 and 88. Spacer rear member 82 is mounted substantially adjacent to the rear ends of frame members 87 and 89. Rear ends of frame members 85 and 88 removably receive rear portion 50. Rear ends of frame members 87 and 89 removably receive rear portion 70. Transversal reinforcement assembly 86 has a substantially T-shape with arms 96 and 96', lower end 81 snugly and removably received by en 24 of front leg assembly 20. As best seen in FIG. 1*a*, flattened end 98 of frame member 88 includes through opening 98' and pin member 198. Through opening 28' of arm member 25 receives therethrough pin member 198. Through opening 28 is aligned with through opening 98' permitting fastening member 138 to go through and mate with thumb nut 138'. Flattened end 99 of frame member 89 includes through opening 99' and pin member 199. Through opening 29' of arm member 27 receives therethrough pin member 199. Through opening 29 is aligned with through opening 99' permitting fastening member 139 to go through and mate with thumb nut 139'. Arms 96 and 96' of transversal reinforcement assembly 86 are removably mounted to frame members 88 and 89, respectively. The flattened ends of transversal reinforcement member 84 are also removably mounted to frame members 88 and 89 at a point next to spacer rear members 82 and 83, respectively.

As represented in FIG. 1, brake mechanisms 110 are mounted to rear portions 50 and 70, so that the user can easily manipulate trainer 10 by reducing the velocity when skating. As seen in FIGS. 2 and 3, brake mechanism 110 includes lever 112, transmission cable 114 with sleeve or cover 124, adjusting member 116 and hook member 118. Upper end 113 of transmission cable 114 is mounted to lever 112, as best seen in FIG. 2. As best seen in FIG. 3, lower end 115 of sleeve 124 is mounted to spring member 125. Form this point on, transmission cable 114 passes through the center of spring member 125 to engage through opening 117 next to the upper end of adjusting member 116. Spring member 125 keeps brake mechanism 110 in no-braking position when the user is not actuating lever 112. As best seen in the enlarged view of FIG. 3*b*, adjusting member 116 includes lower end 126 with threaded through opening 127. Threaded portion 128' of eyebolt 128 passes through opening 127. Wing nut 129 is used as a collar to adjust the relative position of eyebolt 128 with respect to connector member 111 of adjusting member 116. The user adjust member 116 with eyebolt 128 to keep brake mechanism 110 tensed. Eyebolt 128 cooperatively engage hook member 118, as shown in FIG. 3. As best seen in FIG. 3*c*, hook member 118 includes locking mechanism 130 to keep hooked end 119 in place. Locking mechanism 130 includes spring member 132 and sleeve 134. Hook member 118 releasably engages brake assembly 150 mounted to ice skate assemblies 140 and 160.

Figure 4:
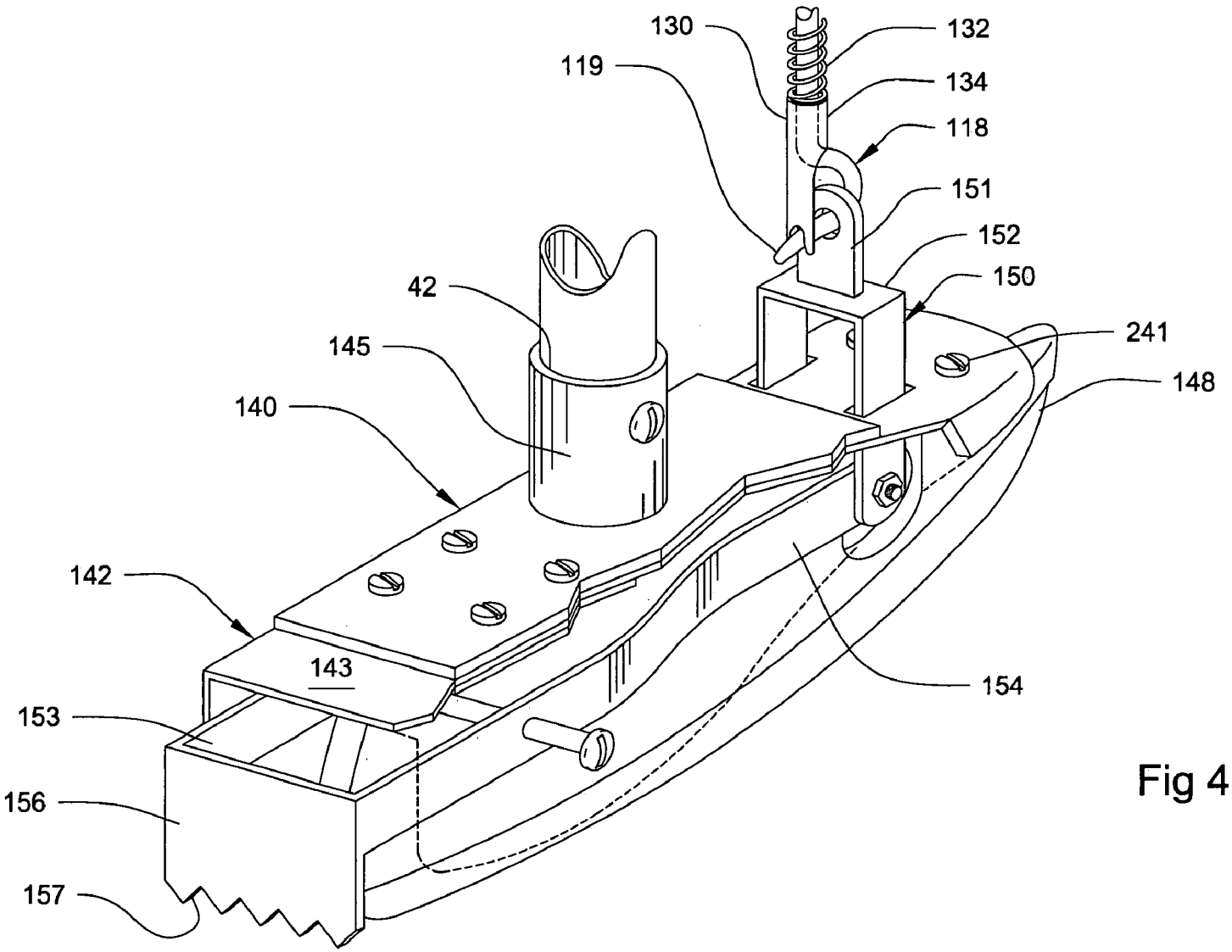
FIG. 4 is an isometric view of one of the ice skate assemblies wherein a portion of one of its lateral walls was removed to show the brake assembly.

Skating blade assemblies 140 and 160 have substantially the same size and configuration. As seen in FIG. 4, skating blade assembly 140 (or 160) includes housing 142, blade member 148 and brake assembly 150. Cylindrical member 145 is mounted to the upperside of housing 142 and removably receives end 42 of leg 40. The user actuates brake mechanism 110 with lever 112. The user's pulling action actuates brake assembly 150. Brake assembly 150 includes actuating member 152, which in turn actuates pivotally mounted elongated bar members 153 and 154. The distal ends of bars 153 and 154 are mounted to teethed plate member 156 that in turn include teeth 157. When the user actuates brake mechanism 110 by pressing lever 112, actuating member 152 moves up urging teethed plate member 156 to go down sinking teeth 157 on the ice surface so that movements of actuating lever 112 result in causing teethed plate member 156 to sink against the ice surface.

As best seen in FIG. 2, locking assembly 180 includes latch member 182 with lever 184. Latch member 182 is hingedly mounted to lever 184, which in turn is hingedly mounted to spacer member 83 through pin 185. Hook terminations 58 and 78 mounted to rear portions 50 and 70, removably receive latch members 182, as shown in FIG. 1. The user cooperatively mount rear portions 50 and 70, inserts latch members 182 in hook terminations 58 and 78 and pulls levers 184 to completely lock rear portions 50 and 70 to frame assembly 80.

Trainer device 10 is preferably made out of a rigid and light material, such as aluminum. The user steers ice skating trainer 10 with front leg assembly 20 through gripping handles 52 and 72 and actuating brake mechanism 110 and maintain the equilibrium.

The user steers ice skating trainer 10 by applying his/her weight on handles 52 and 72 and/or actuating brake mechanisms 110.

Figure 7:
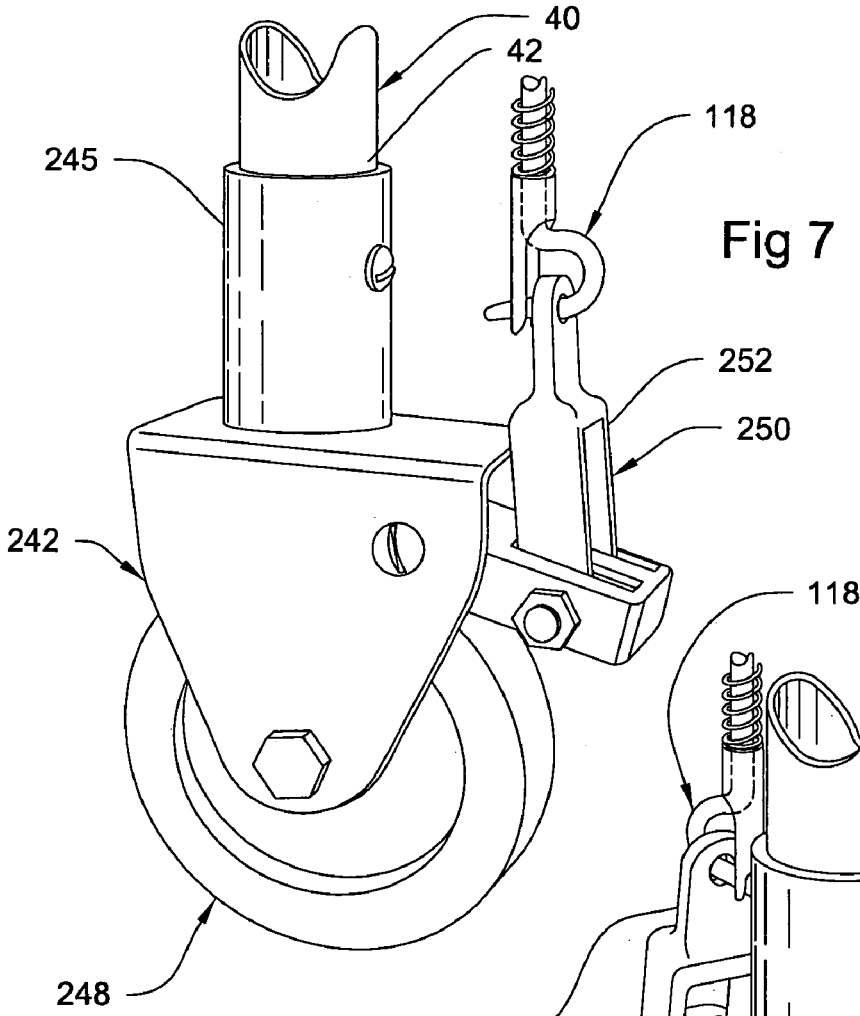
FIG. 7 is an isometric view of one of the rear wheel assemblies as an accessory to be mounted to the rear leg assemblies.
Figure 8:
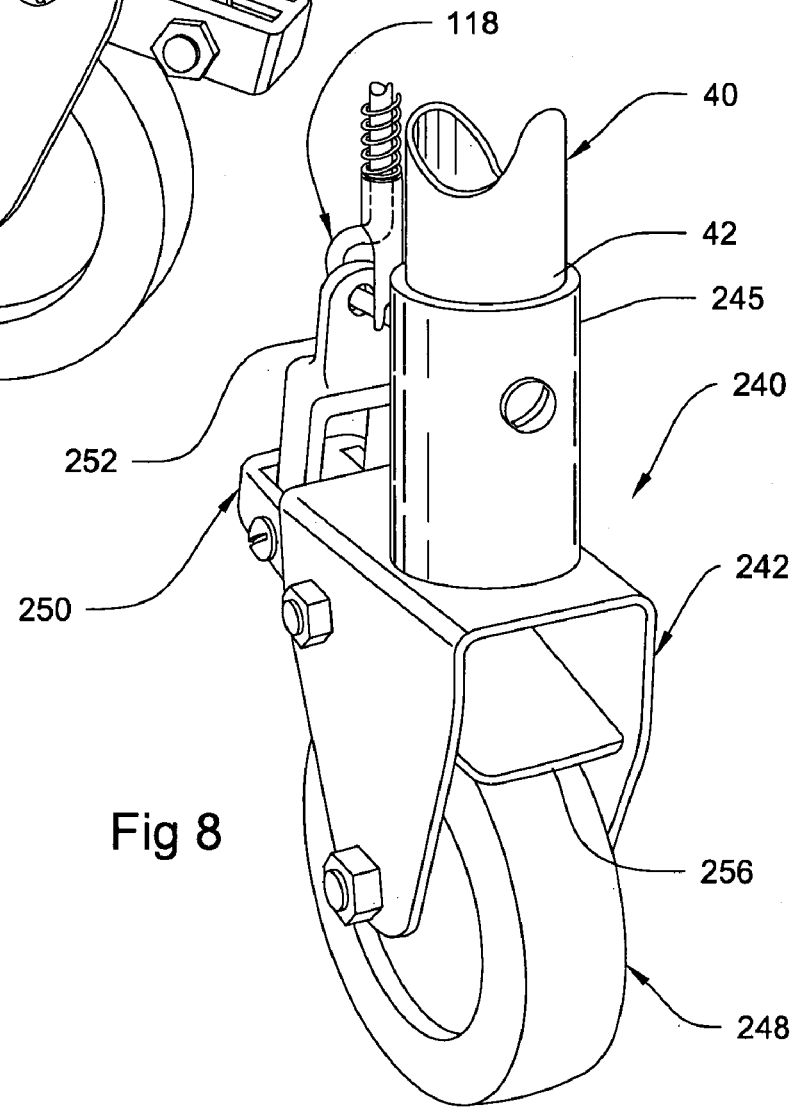
FIG. 8 is a rear isometric view of one of the rear wheel assemblies as an accessory to be mounted to the rear leg assemblies.

As shown in FIGS. 7 and 8, rear wheel assembly 240 can be optionally mounted to rear leg assemblies 40 and 60 when the user wants to be trained with wheel skating instead of ice skating. Rear wheel assembly 240 includes housing 242, wheel member 248 and brake assembly 250. Cylindrical member 245 is mounted to the upperside of housing 242 and removably receives end 42 of leg 40 (or end 62 of leg 60). Brake assembly 250 includes actuating member 252 removably mounted to hook member 118. Actuating member 252 actuates pivotally mounted brake plate 256, as best seen in FIG. 8. When a user actuates brake mechanism 110 by pressing lever 112, actuating member 252 moves up urging teethed plate member 156 to go down making contact with wheel member 248 resulting in braking action.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A skate training device, comprising:

A) frame means having a substantially arched V-shape with a front end and first and second rear portions;

B) a first leg assembly having first and second end, said first end being mounted to said front end;

C) wheel means mounted to said second end and including a wheel member for partially supporting said frame means over an ice surface;

D) first and second handles means mounted to said first and second rear portions, respectively, said first and second handle means being kept at a predetermined distance from said ice surface;

E) a second leg assembly having third and fourth ends, said third end being mounted to said first rear portion;

F) first skating blade means mounted to said fourth end to slidably support said frame means over said ice surface;

G) first brake means having an actuating lever cooperatively mounted adjacent to said first handle means and said first brake means including means for transmitting the movement of said actuating lever and further including an elongated bar member pivotally mounted to said first skating blade means having a braking teethed plate mounted to said elongated bar member so that predetermined movements of said actuating lever result in causing said teethed plate member to sink against said ice surface;

H) a third leg assembly having fifth and sixth ends, said fifth end being mounted to said second rear portion;

I) second skating blade means mounted to said sixth end to slidably support said frame means over said ice surface; and J) second brake means having an actuating lever cooperatively mounted adjacent to said second handle means and said second brake means including means for transmitting the movement of said actuating lever and further including an elongated bar member pivotally mounted to said second skating blade means having a braking teethed plate mounted to said elongated bar member so that predetermined movements of said actuating lever result in causing said teethed plate member to sink against said ice surface.

2. The skate training device set forth in claim 1 wherein said frame means has two substantially arched V-shape members each having a front end and first and second rear portions, said first rear portions being kept apart by a first spacer member and said second rear portions being kept apart by a second spacer member.

3. The skate training device set forth in claim 2 wherein said wheel member swivels freely.

* * * * *